United States Patent [19]

Jackson

[11] Patent Number: 4,943,039

[45] Date of Patent: Jul. 24, 1990

[54] ADJUSTABLE CLAMP

[76] Inventor: Ronald E. Jackson, 216 W. Southport Rd., Indianapolis, Ind. 46217

[21] Appl. No.: 322,546

[22] Filed: Mar. 13, 1989

[51] Int. Cl.[5] ..... B25B 1/20

[52] U.S. Cl. ..... 269/45; 81/180.1; 269/97

[58] Field of Search ..... 269/37, 43, 45, 71, 269/97, 98; 81/124.4, 124.5, 180.1, 184, 185.2, 418, 419, 424.5, 125.1; 403/46, 307

[56] References Cited

U.S. PATENT DOCUMENTS

| | | | |
|---|---|---|---|
| 476,754 | 6/1892 | Mendelson | 269/45 |
| 2,510,198 | 6/1950 | Tesmer | 248/226 |
| 2,628,522 | 2/1953 | Kraft | 81/125.1 |
| 2,836,139 | 5/1958 | Holmberg | 269/45 |
| 2,980,948 | 4/1961 | McCain | 17/8 |
| 3,112,104 | 11/1963 | Jerore | 269/75 |
| 3,883,128 | 5/1975 | Breese | 269/45 |
| 3,907,269 | 9/1975 | Baker, Jr. | 269/55 |
| 4,070,011 | 1/1978 | Glesser | 269/45 |
| 4,214,739 | 7/1980 | Dailey | 269/75 |
| 4,253,649 | 3/1981 | Hewson | 269/45 |
| 4,258,597 | 3/1981 | Gelman | 81/184 |
| 4,834,352 | 5/1989 | Thornton | 269/6 |

FOREIGN PATENT DOCUMENTS

| | | | |
|---|---|---|---|
| 1546254 | 5/1979 | United Kingdom | 403/307 |

*Primary Examiner*—J. J. Hartman

*Attorney, Agent, or Firm*—Barnes & Thornburg

[57] ABSTRACT

A holding apparatus includes a first clamp and a second clamp. Each clamp having a handle, and a coupler for coupling the handles of the clamps together. The coupler includes a first rod and a second rod, with each rod having a right angled leg, the legs being shorter than the rod, and the ends of each rod being threaded. A coupling engaging the threads on one end of each of the rods to adjustably join the rods together and wing nut engages one thread in interfering engagement. Connecting elements connect the legs to a respective clamp handle. Each connecting element includes a ring rotatably surrounding the second leg and having an integral stem projecting radically from the ring. The stem projects through a clamp handle to permit pivotal movement of the clamp handle around the stem, thereby providing five axes of movement between the two clamps. Each connecting element has a nut threadedly engaging the leg for movement into interfering engagement with the ring to prevent rotational movement around the leg and a nut threadedly engaging the stem for movement into interfering engagement with the clamp handle to prevent movement of the clamp handle about the stem.

20 Claims, 1 Drawing Sheet

ADJUSTABLE CLAMP

BACKGROUND OF THE INVENTION

The present invention relates generally to clamping devices and more particularly to apparatus having a spaced pair of clamping members coupled by an articulated coupling permitting adjustment of the relative position of the pair of clamping members.

Many forms of clamping and positioning devices are known in the prior art which include a pair of spaced clamping members which may be used, for example, to support a workpiece with respect to an element of structure, or to support two workpieces in relationship to each other. It has long been recognized that the presence or absence of supporting structure, surrounding equipment, tool piece configuration, or other physical problems are often encountered which restrict the orientation of the one or more workpieces. It is therefore an object of the present invention to provide an adjustable clamping device having enhanced flexibility and articulation which will permit a workpiece or a pair of workpieces to be situated with ease at a desired location.

It has also been long recognized that apparatus of this general type must not only be capable of being oriented or positioned in the desired location but must also be easily adjusted with the minimum use of any tools yet must be capable of being rigidly secured at a desired location so that any workpiece or workpieces are not subject undesired displacement. The adjustment of position must be able to be achieved with the minimum use of skill and without any requirement for equipment disassembly or reassembly.

SUMMARY OF THE INVENTION

Apparatus according to the present invention comprises a first clamp and a second clamp, each clamp including at least one handle and coupling means for coupling the first clamp handle to the second clamp handle. The coupling means generally comprises a rod-like member and connecting means for connecting the rod-like member to each of the clamp handles. The rod-like member comprises a first rod and a second rod, each rod having a pair of legs joined by an angle portion. One leg of each rod is preferably longer than the other leg. Joining means is provided for joining a first leg of the first rod to a first leg of the second rod. The joining means includes an adjustment means for permitting adjustment of the relative position of the two rods with respect to each other and fixing means for fixing the relative position of the two rods. In the preferred embodiment, the joining means joins the first and second rods such that the first legs of the rods are colinearly arranged, the adjustment means permitting angular adjustment of one rod with respect to the other about their common colinear axes while maintaining their colinearity.

The second leg of each rod is in turn connected to a clamp handle by the connecting means. Each connecting means includes ring means surrounding the second leg and stem means projecting from the ring means, the ring means being moveable with respect to the second leg to permit angular adjustment of the stem means with respect to the second leg. The stem means projects through a clamp handle in a manner as to permit pivotal movement of the clamp handle around the stem means. Securing means is provided for securing the angular position of the ring means with respect to the second leg. Locking means is provided for locking the position of the clamp handle with respect to the stem means.

In the preferred embodiment, the fixing means fixing the relative position of the two rods, the securing means securing the angular position of the ring means with respect to the second leg, and the locking means for locking the position of the clamp handle with respect to the stem means are each in the form of a wing nut so as to permit the apparatus to be adjusted and secured in position without the necessity of tools. There is, however, provided a special wrench intended to manipulate the wing nuts where extra strength of positioning is required. The wrench comprises in an elongated bar having a slot aligned with the elongation axis of the bar. In the preferred form, the slot comprises a pair of slots aligned with and spaced along the elongation axis of the bar with one of the slots having an open end. The wrench is preferably sized so as to be stored, when not in use, in one of the handles of the holding apparatus.

In a preferred embodiment in the invention, each clamp includes a first and second handle and a jaw having opposed holding surfaces. The first and second handle and the jaw form a generally triangular configuration which in the appropriate circumstance can act as a base supporting the remainder of the apparatus. Each clamp handle includes a spring means biasing the jaw holding surfaces together. At least one of the pair of clamps of the apparatus further comprises a pair of opposing members adjacent to the jaw holding surfaces, the opposing members forming a second pair of points for contacting a workpiece, supporting structure, or the like.

One feature of the present invention is that the adjusting means, both ring means, and both stem means, each can provide 360° of adjustment, thereby providing five degrees of freedom for adjustment of the position of one clamp element relative to the other. By clamping the jaws of one of the clamps to a fixed object, the jaws of the other clamp can then be used to hold a workpiece in a desired relationship with respect to the fixed object. Alternatively, both sets of jaws can be used to be clamped to one or two objects to hold the object or objects at a desired relationship with respect to an underlying surface upon which the apparatus is caused to rest. Other features and advantages of the present invention will become apparent to those skilled in the art upon consideration of the following detailed description of the illustrated preferred embodiment exemplifying the best mode of carrying out the invention as presently perceived. The detailed description particularly refers to the accompanying figures.

DESCRIPTION OF THE PREFERRED EMBODIMENT

Figure 1:
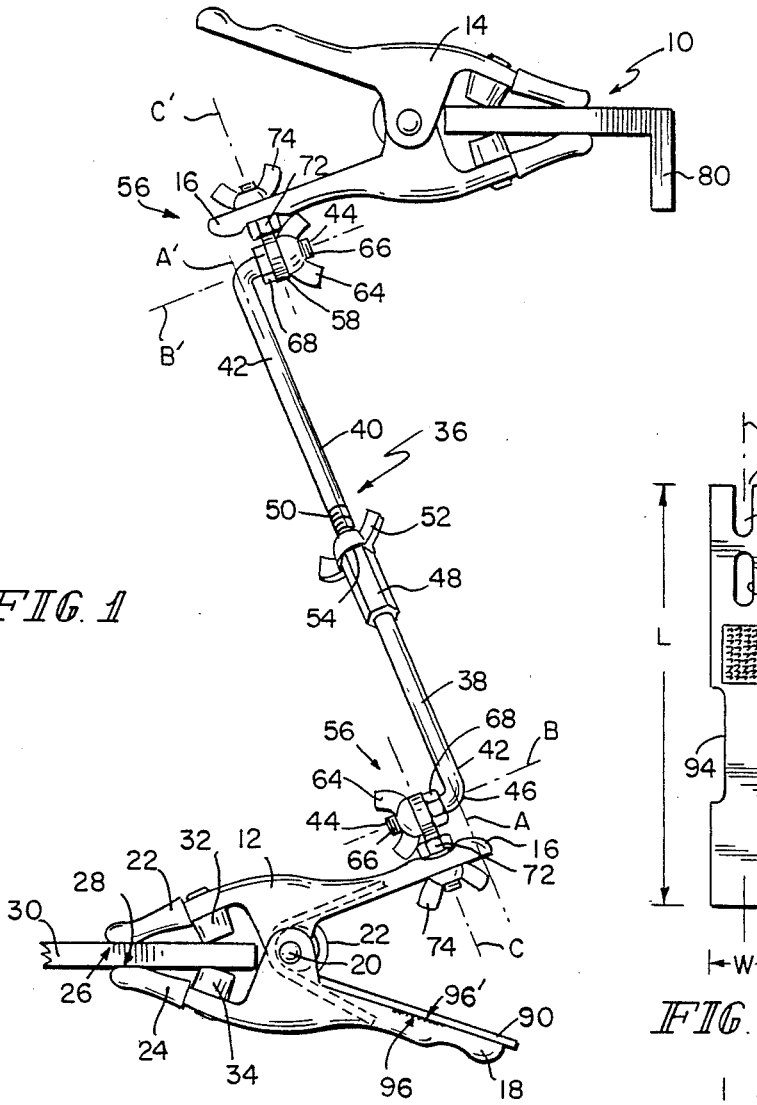
FIG. 1 is a side elevation view of an apparatus in accordance with the invention holding a workpiece with respect to a support to which the apparatus is clamped.
Figure 2:
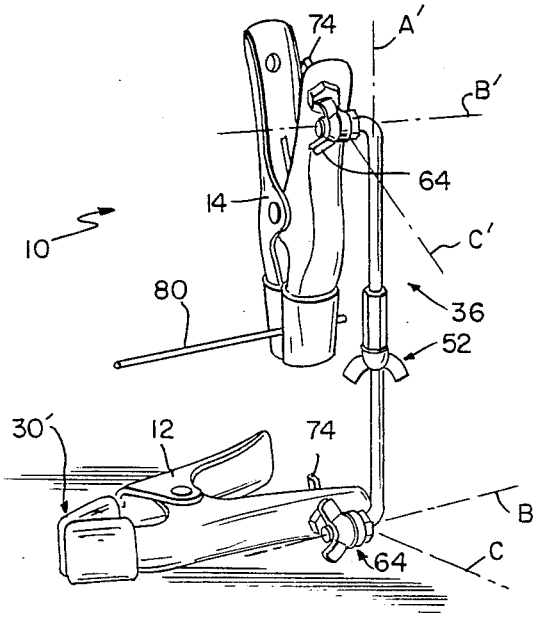
FIG. 2 is a perspective view of the apparatus shown in FIG. 1 but repositioned to hold another workpiece with respect to a horizontal surface.

An adjustable clamping or holding apparatus 10 is shown in two different positions in FIGS. 1 and 2. The apparatus 10 comprises generally a first clamp 12 and a second clamp 14. Each clamp includes a first handle 16 and a second handle 18 which are pivoted about a common axis defined by pin 20. The handles 16 and 18 are biased away from each other by a spring means 22 surrounding the pin means 20 and contacting interior surfaces of handles 16 and 18.

Forward of the axis-defining pin 20 are jaws 22 and 24 having opposed holding surfaces 26 and 28, respectively. The biasing action of the spring means 22 biases the opposed holding surfaces 26 and 28 toward contact with each other. As illustrated in FIG. 1, the holding surfaces 26 and 28 are positioned on opposite sides of a support 30. An additional pair of elastomeric bumpers 32 and 34 are included on an inner surface of the jaws 22 and 24 approximately midway between the pin defining axis 20 and the opposed holding surfaces 26 and 28. The elastomeric elements 32 and 34 oppose each other and act as a second pair of holding surfaces for holding an item such as the support 30.

A rod-like coupling means 36 couples the first handle 16 of clamp 12 to the first handle 16 of clamp 14. The coupling means 36 includes a first rod 38 and a second rod 40, each of the rods 38 and 40 includes a first longer leg 42 and a second shorter leg 44 joined together by an angled portion 46. The angle defined by the angle portion 46 is such that the axis A, A′ of the longer leg is at a right angle to the axis B, B′ of the shorter leg. The two rods 40 and 42 are joined together by a joining means 48 in the form of an elongated coupling nut fixed securely to rod 38. Rod 40 includes an adjustment means 50 in the form of threads engaging in an inner surface of the joining means 48 which permit the position of rod 40 to be adjusted with respect to rod 38. A fixing means 52 in the form of a wing nut 52 also engages the threads 50 and is moveable into interfering contact with end 54 of joining means 48 to fix the position of rod 40 with respect to rod 38. The joining means 48 joins the two rods 38 and 40 such that the axis A of rod 38 is colinear with the axis A′ of rod 40. The adjustment of position of rod 38 with respect to rod 40 permits the rotation of rod 40 with respect to 38 but maintains the colinearity of axis A and axis A′.

Figure 3:
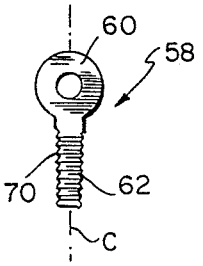
FIG. 3 is an elevation view of an eye bolt forming a ring means and stem means in accordance with the present invention.

A connecting means 56 connects each of the second legs 44 to the first handle 16 of one of the clamps 12 and 14. The connecting means 56 includes an eye-bolt shown in detail in FIG. 3. The eye-bolt 58 comprises a ring means 60 which surrounds the second leg 44 and is moveable with respect to the second leg 44. A stem means 62 projects radially from the ring means 60. The angular adjustment of the ring means 60 around a second leg 44 permits the angular adjustment of the stem means 62 with respect to the two axis B and B′. A securing means 64 in the form of a wing nut secures the angular position of the ring means 60 with respect to the second leg 46. To accomplish this, the second leg includes a threaded portion 66. A nut 68 engages the end of the threaded portion 66 closest to angled portion 46, the nut 68 forming a stop. The wing nut 64 may then be tightened to increase the frictional engagement between the stop nut 68, the ring means 60, and wing nut 64.

The stem means 62 can be seen to define yet another axis C. Each stem means 62 includes a threaded portion 70 on which stop nut 72 is engaged. The stem means 62 is inserted through a hole (not shown) in handle 16 to permit pivotal movement of the handle and clamp around the axis C. A locking means 74 in the form of a wing nut permits the locking of the position of the clamp handle 16 with respect to the stem means 62 by a frictional engagement of the handle between the locking means 74 and stop nut 72. Various washers including conventional lock washers can optionally be included as a part of the fixing means 52 securing means 64 and locking means 74.

It will be appreciated that an apparatus as illustrated in FIGS. 1 and 2 is capable of angular adjustment about each of the axis A, B, B′, C, and C′. This five axis adjustment permits the apparatus to be situated in virtually any possible possible position which one would desire to hold a workpiece 80 relative to a supporting structure 30. Clamp handles 16 and 18 as well as jaws 22 and 24 are shown to generally take the shape of a triangle. Thus one of the clamps 12 or 14 can itself be employed as a stable base as shown in FIG. 2 for supporting a workpiece 80 above a generally planar supporting surface 30′. By adjusting the apparatus about the five axes, one is able to achieve an exceptionally stable support which would be unlikely to be displaced from the desired position. Many additional configurations for the apparatus can be achieved and the accompanying figures are not intended to be limiting in any way as to the utility of the illustrated apparatus.

Figure 4:
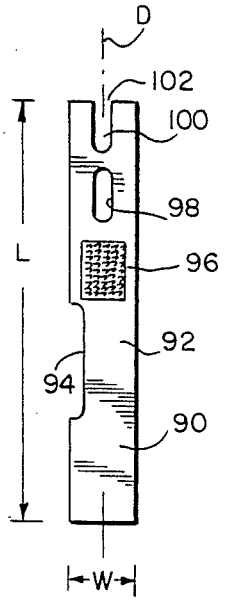
FIG. 4 is a plan view of a wrench included in the apparatus for tightening and loosening the wing nuts forming the fixing means, securing means, and locking means of the present invention.

From time to time, it may be necessary to ensure that the relative position sought to be maintained by the apparatus is more secure than that which might be ordinarily achieved by merely tightening the various wing nuts 52, 64, 74 using one's fingers. There is therefore provided a tool 90 for use in connection with manipulating the various wing nuts 52, 64, and 74. The tool 90, of course, may have other uses and may be employed for use in connection for other apparatus. The tool 90 generally comprises an elongated bar 92 as shown in FIG. 4. To permit easy storage of the tool 90, the bar 92 has a width W many times greater than its thickness, the thickness dimension being shown as the tool is stored in handle 18. The length of the tool L is generally several times the width W. One side of the bar 92 includes a notch 94. The notch 94 is provided to permit easy insertion of the tool 90 into handle 18 without interference with the spring means 22. One surface of the tool 90 includes a securing means 96 in the form of a segment of hooked fabric, commonly known under the trademark VELCRO, for securing the tool 90 to handle 18. The tool 90 includes a pair of slots 98 and 100 which are generally colinear and aligned with a major axis D of the tool 90. The length of the slots 98 and 100 and the distance of separation between the slots is selected so that the two slots 98 and 100 will easily engage the two wings of a wing nut, for example, wing nuts 52, 64, and 74. Slot 100 is shown to include an open end 102 to permit a sliding engagement with one of the wings of the wing nut. To secure the tool 90 to handle 18, a matching fastening fabric or equivalent means 96′ will be mounted within handle 18 so that the tool 90 can be easily stored except when in use to tighten or loosen the wing nuts of the apparatus.

Although the invention has been described in detail with reference to the illustrated preferred embodiment, variations and modifications exist within the scope and spirit of the invention as described and as defined in the following claims.

What is claimed is:

1. A holding apparatus comprising:

a first and second clamp;

each clamp having a two arm handle each arm having a clamp end and an operator end;

coupling means for joining one of the two arm handles of the first clamp to a one of the two arm handles of the second clamp;

said coupling means including a U-shaped member comprising two leg portions separated by a bight portion;

said coupling means also including two connection means, one connection means connecting the one of the two arm handles of the first clamp to one of the legs of the two legged U-shaped member and another of the two connection means connecting the one of the two arm handles of the second clamp to the other of the two legs of the two legged U-shaped member;

wherein said connection means permit rotation of the clamps about a longitudinal axis of the legs of the U-shaped member as well as permitting rotation of the clamps along an axis at right angles to said longitudinal axis;

each of said connection means including two independently operable securing means for locking the rotation of one of the clamps with respect to the U-shaped member;

wherein one of the two securing means stops one of the clamps from rotating about the longitudinal axis of the leg of the U-shaped member without stopping rotation of the one clamp along the axis at right angles to said longitudinal axis; and;

wherein the other of the two securing means stops rotation of the one clamp at a right angle to said longitudinal axis without stopping rotation of the one clamp about the longitudinal axis of the leg of the U-shaped member.

2. A holding apparatus according to claim 1, wherein the coupling means also includes an adjustable coupling member means in the bight of the U-shaped member for adjusting the angular orientation of the two legs of the U-shaped member relative to each other.

3. A holding apparatus according to claim 1, wherein the connection means comprises a ring member with a shaft;

wherein the legs of the U-shaped member are threaded;

wherein the ring member surrounds the threaded legs of the U-shaped member;

wherein the one of the securing means comprises screw members which threadingly engages the threads on the legs of the U-shaped member; and wherein the other of the securing means comprises screw members that are threaded on the shaft of the ring member.

4. A holding apparatus according to claim 2, wherein the connection means comprises a ring member with a shaft;

wherein the legs of the U-shaped member are threaded;

wherein the ring member surrounds the threaded legs of the U-shaped member;

wherein the one of the securing means comprises screw members which threadingly engages the threads on the legs of the U-shaped member; and wherein the other of the securing means comprises screw members that are threaded on the shaft of the ring member.

5. A holding apparatus according to claim 1, wherein each clamp end has two clamping surfaces that are separated from one another to permit the clamps to securely grasp flat and round objects with a four point contact using four clamping surfaces, two surfaces from each arm handle, wherein the object is touched by each of the two clamping surfaces on each arm handle to grasp the object therebetween.

6. A holding apparatus according to claim 2, wherein each arm handle of each clamp has two clamping surfaces that are separated from one another to permit the clamps to securely grasp flat and round objects with a four point contact using four clamping surfaces, two surfaces from each arm handle, wherein the object is touched by each of the two clamping surfaces on each arm handle to grasp the object therebetween.

7. A holding apparatus according to claim 3, wherein each arm handle of each clamp has two clamping surfaces that are separated from one another to permit the clamps to securely grasp flat and round objects with a four point contact using four clamping surfaces, two surfaces from each arm handle, wherein the object is touched by each of the two clamping surfaces on each arm handle to grasp the object therebetween.

8. A holding apparatus according to claim 4, wherein each arm handle of each clamp has two clamping surfaces that are separated from one another to permit the clamps to securely grasp flat and round objects with a four point contact using four clamping surfaces, two surfaces from each arm handle, wherein the object is touched by each of the two clamping surfaces on each arm handle to grasp the object therebetween.

9. A holding apparatus according to claim 1, wherein the clamps of the holding means can be adjusted so the holding apparatus is able to stand by itself with jaws of the clamps being able to hold objects by having the bight of the U-shaped member and operator ends of the clamps rest on a flat surface.

10. A holding apparatus according to claim 2, wherein the clamps of the holding means can be adjusted so that the holding apparatus is able to stand by itself with jaws of the clamps being able to hold objects by having the bight of the U-shaped member and operator ends of the clamps rest on a flat surface.

11. A holding apparatus according to claim 3, wherein the clamps of the holding means can be adjusted so the holding apparatus is able to stand by itself with jaws of the clamps being able to hold objects by having the bight of the U-shaped member and operator ends of the clamps rest on a flat surface.

12. A holding apparatus according to claim 4, wherein the clamps of the holding means can be adjusted so the holding apparatus is able to stand by itself with jaws of the clamps being able to hold objects by having the bight of the U-shaped member and operator ends of the clamps rest on a flat surface.

13. A holding apparatus according to claim 5, wherein the clamps of the holding means can be adjusted so the holding apparatus is able to stand by itself with jaws of the clamps being able to hold objects by having the bight of the U-shaped member and operator ends of the clamps rest on a flat surface.

14. A holding apparatus according to claim 6, wherein the clamps of the holding means can be adjusted so the holding apparatus is able to stand by itself with jaws of the clamps being able to hold objects by having the bight of the U-shaped member and operator ends of the clamps rest on a flat surface.

15. A holding apparatus according to claim 7, wherein the clamps of the holding means can be adjusted so the holding apparatus is able to stand by itself with jaws of the clamps being able to hold objects by having the bight of the U-shaped member and operator ends of the clamps rest on a flat surface.

16. A holding apparatus according to claim 8, wherein the clamps of the holding means can be adjusted so the holding apparatus is able to stand by itself with jaws of the clamps being able to hold objects by having the bight of the U-shaped member and operator ends of the clamps rest on a flat surface.

17. A holding apparatus comprising:

a first and second clamp;

each clamp having a two arm handle each arm having a clamp end and an operator end;

coupling means for joining one of the two arm handles of the first clamp to a one of the two arm handles of the second clamp;

said coupling means including a U-shaped member comprising two leg portions separated by a bight portion;

said coupling means also including two connection means, one connection means connecting the one of the two arm handles of the first clamp to one of the legs of the two legged U-shaped member and another of the two arm handles of the second clamp to the other of the two legs of the two legged U-shaped member;

wherein said connection means permit rotation of the clamps about a longitudinal axis of the legs of the U-shaped member as well as permitting rotation of the clamps along an axis at right angles to said longitudinal axis;

wherein each arm clamp end has two clamping surfaces that are separated from one another to permit the clamps to securely grasp flat and round objects with a four point contact using four clamping surfaces, two surfaces from each arm handle, wherein the object is touched by each of the two clamping surfaces on each arm handle to grasp the object therebetween.

18. A holding apparatus according to claim 17 wherein the clamping surfaces are made from a plastic material.

19. A holding apparatus comprising:

a first and second clamp;

each clamp having a two arm handle each arm having a clamp end and an operator end;

coupling means for joining one of the two arm handles of the first clamp to a one of the two arm handles of the second clamp;

said coupling means including a U-shaped member comprising two leg portions separated by a bight portion;

said coupling means also including two connection means, one connection means connecting the one of the two arm handles of the first clamp to one of the legs of the two legged U-shaped member and another of the two connection means connecting the one of the two arm handles of the second clamp to the other of the two legs of the two legged U-shaped member;

wherein said connection means permit rotation of the clamps about a longitudinal axis of the legs of the U-shaped member as well as permitting rotation of the clamps along an axis at right angles to said longitudinal axis;

wherein the clamps of the holding means can be adjusted so the holding apparatus is able to stand by itself with jaws of the clamps being able to hold objects by having the bight of the U-shaped member and operator ends of the clamps rest on a flat surface.

20. A holding apparatus according to claim 19, wherein the coupling means is adjustable to allow the vertical distance between the two clamps to be adjusted as well as providing for the legs of the U-shaped member to be rotated with respect to one another.

* * * * *

UNITED STATES PATENT AND TRADEMARK OFFICE

CERTIFICATE OF CORRECTION

PATENT NO. : 4,943,039

DATED : July 24, 1990

INVENTOR(S) : Jackson

It is certified that error appears in the above-identified patent and that said Letters Patent is hereby corrected as shown below:

In column 6, line 14, replace "arm handle of each clamp" with --clamp end--.

In column 6, line 23, replace "arm handle of each clamp" with --clamp end--.

In column 6, line 32, replace "arm handle of each clamp" with --clamp end--.

In column 7, line 35, after "two", insert --connection means connecting the one of the two--.

Signed and Sealed this

Twenty-second Day of October, 1991

*Attest:*

*Attesting Officer*

HARRY F. MANBECK, JR.

*Commissioner of Patents and Trademarks*